US005758829A

United States Patent [19]

Itoh et al.

[11] Patent Number: 5,758,829

[45] Date of Patent: Jun. 2, 1998

[54] FUEL INJECTION VALVE FOR INTERNAL COMBUSTION ENGINES

[75] Inventors: Katsuoki Itoh, Leonberg; Christoph Treutler, Wannweil; Guenter Lewentz, Hemmingen; Bernd Dittus, Tamm; Gilbert Moersch; Christoph Franke, both of Stuttgart; Reiner Schuetz, Rossdorf; Hans-Friedemann Kober, Tuebingen, all of Germany

[73] Assignee: Robert Bosch GmbH, Stuttgart, Germany

[21] Appl. No.: 555,623

[22] Filed: Nov. 9, 1995

[30] Foreign Application Priority Data

Nov. 11, 1994 [DE] Germany ..... 44 40 369.0

[51] Int. Cl.[6] ..... F02M 59/00

[52] U.S. Cl. ..... 239/533.2; 239/533.12; 239/584; 137/625.13; 251/120

[58] Field of Search ..... 239/533.1, 533.2, 239/533.3, 533.7, 533.8, 533.9, 533.12, 533.15, 583, 584, 585.4; 137/625.3; 251/120

[56] References Cited

U.S. PATENT DOCUMENTS

| | | | |
|---|---|---|---|
| 4,390,129 | 6/1983 | Uchida | 239/533.5 |
| 4,817,873 | 4/1989 | McKay | 239/533.12 |
| 4,842,018 | 6/1989 | White et al. | 139/614.11 |
| 4,967,959 | 11/1990 | Wiezorek | 239/533.2 |
| 5,271,430 | 12/1993 | Muruyama et al. | 137/625.3 |
| 5,405,088 | 4/1995 | Gordon et al. | 239/453 |
| 5,482,018 | 1/1996 | Potz et al. | 123/405 |
| 5,497,947 | 3/1996 | Potz et al. | 239/533.12 |
| 5,503,184 | 4/1996 | Reinartz et al. | 137/625.3 |

FOREIGN PATENT DOCUMENTS

460381B1 4/1991 European Pat. Off. .

*Primary Examiner*—Andres Kashnikow
*Assistant Examiner*—Lisa Ann Douglas
*Attorney, Agent, or Firm*—Edwin E. Greigg; Ronald E. Greigg

[57] ABSTRACT

A fuel injection valve for internal combustion engines with a valve member which is displaced in a bore in a valve body by the fuel pressure, counter to the action of a closing spring. The valve body has at a combustion-space end, a valve head which on a side which faces the valve body is arranged a sealing surface which interacts with a valve seat provided on the combustion-space end of the valve body, forming a sealing cross section, and including injection apertures which permit a flow of fuel from a pressure space in the valve body to the combustion space of the internal combustion engines and has an aperture cross section which can be varied as a function of the stroke of the valve member. According to the invention, those parts which seal off the injection valve from the outside and those parts which form the aperture cross section of the injection openings are geometrically separated from one another, the sealing cross section which closes the valve off from the outside being arranged downstream, as seen in the injection direction, of the variable aperture cross section, which is situated radially to the inside.

12 Claims, 4 Drawing Sheets

FUEL INJECTION VALVE FOR INTERNAL COMBUSTION ENGINES

PRIOR ART

The invention starts from a fuel injection valve for internal combustion engines. In a fuel injection valve of this kind of the outward-opening type, known from EP 0 460 381 B1, an axially displaceable valve member is guided in a bore in a valve body. At one end, the valve member has a head of enlarged diameter which protrudes from the bore and on that end which is nearest to the valve body is arranged a sealing surface which interacts with a valve seat surface provided on the end of the valve body. Via a feed line and a pressure space, the valve member can be subjected in such a way to high fuel pressure delivered by a high-pressure feed pump that it rises outwards from its valve seat counter to the force of a return or closing spring and opens an aperture cross section between the sealing surface on the valve member and the valve seat surface, via which cross section the fuel is injected from the pressure space in the valve body into the combustion space of the internal combustion engine to be supplied.

In order to achieve an aperture cross section which is variable for different speeds and load ranges of the internal combustion engine, the valve head of the known injection valve is provided with spline toothing with conically extending sealing surfaces, the radially oriented ribs of which toothing are guided in axially movable fashion in complementary slots in the valve body, thereby making it possible, during the opening stroke movement of the valve member, to open a plurality of rectangular aperture cross sections distributed around the circumference, the size of which cross sections can be varied by means of the stroke of the valve member.

However, the known fuel injection valve has the disadvantage that the variable aperture cross section is formed directly by the sealing surfaces, with the result that cocking occurring on the sealing surfaces can lead to the metering accuracy of the fuel injection valve being affected and consequently this has a negative effect on fuel preparation and combustion in the combustion space of the internal combustion engine.

ADVANTAGES OF THE INVENTION

In contrast, the fuel injection valve according to the invention has the advantage that influencing of the metering activity of the injection valve by cocking of the sealing surfaces of the sealing cross section is reliably avoided by means of the geometrical separation of the sealing cross section and the aperture cross section. The arrangement of an outer sealing cross section here advantageously prevents penetration of particulates into the fine guiding gap between the moving parts and into the injection apertures.

In the injection valve according to the invention, the variable injection or aperture cross section is formed in a structurally simple manner by means of two annular inserts which can be displaced axially relative to one another and the mutually facing end faces of which have crown toothings which are in each case mutually complementary and between which the aperture cross section is formed. In this arrangement, a first annular insert is advantageously arranged in a fixed location on the valve body and a second annular insert is axially displaceable relative to the first by virtue of its arrangement on the valve member. The internal wall surface of the annular inserts is here subjected to the high fuel pressure, and in the region of the aperture cross sections the annular inserts are sealed off relative to the combustion space of the internal combustion engine by means of a sealing region formed between the end face of the valve body and a valve-head region situated radially to the outside of the annular inserts.

In order to avoid an uncontrolled flow of fuel outside the aperture cross sections, the gaps forming an axial guide between the slot flanks of the crown toothings are made very small (about 1 μm). A zero clearance would be the optimum. In order to permit manufacture with such accuracy, micromechanical production techniques are advantageously used, it being particularly advantageous to connect the complementary crown toothings by means of an electrodeposited sacrificial layer before installation in the injection valve, this resulting not only in a simplification of assembly (no damage to the highly accurate surfaces) but also in high accuracy of the fit after the separation of the annular inserts, with the result that economical and accurate series manufacture is also possible.

The complete separation of the sealing cross section and the aperture cross section furthermore makes it possible to use different materials at the sealing cross section and the aperture cross section, making it possible in each case to use the materials which are most suitable at these locations, it being possible in addition, for example, to apply cavitation- and wear-reducing layers of hard material to the crown toothings of the annular inserts.

A further advantage of the fuel injection valve according to the invention is the simultaneous opening of the aperture cross section with that of the sealing cross section, this ensuring that injection is in fact limited to the aperture cross sections and that uncontrolled outflow via the entire annular gap of the sealing cross section does not occur.

The geometry of the injection holes can be made relatively variable, in particular by means of the shaping of the end faces of the studs and the slot base, it being necessary for only some of the slot flanks to be made parallel to the axis for reliable sealing. Thus, for example, oblique arrangement of the injection apertures is possible, allowing the position of the emerging fuel jet to be adjusted.

In order to protect the stud of the crown toothing, which is narrow in the case of small injection apertures, from deformation due to the high fuel pressures as it emerges from the guidance provided by the slot flanks, it is possible, by means of a step, to form another pressure space at the annular insert, this subjecting the stud part emerging from the slot uniformly to the fuel pressure and thus supporting the stud even outside the guidance provided by the slot flanks.

Further advantages and advantageous developments of the subject matter of the invention can be taken from the description, the drawing and the claims.

BRIEF DESCRIPTION OF THE DRAWINGS

Two exemplary embodiments of the fuel injection valve according to the invention for internal combustion engines are depicted in the drawing and are explained in greater detail in the following description.

DETAILED DESCRIPTION OF THE EXEMPLARY EMBODIMENTS

Figure 1:
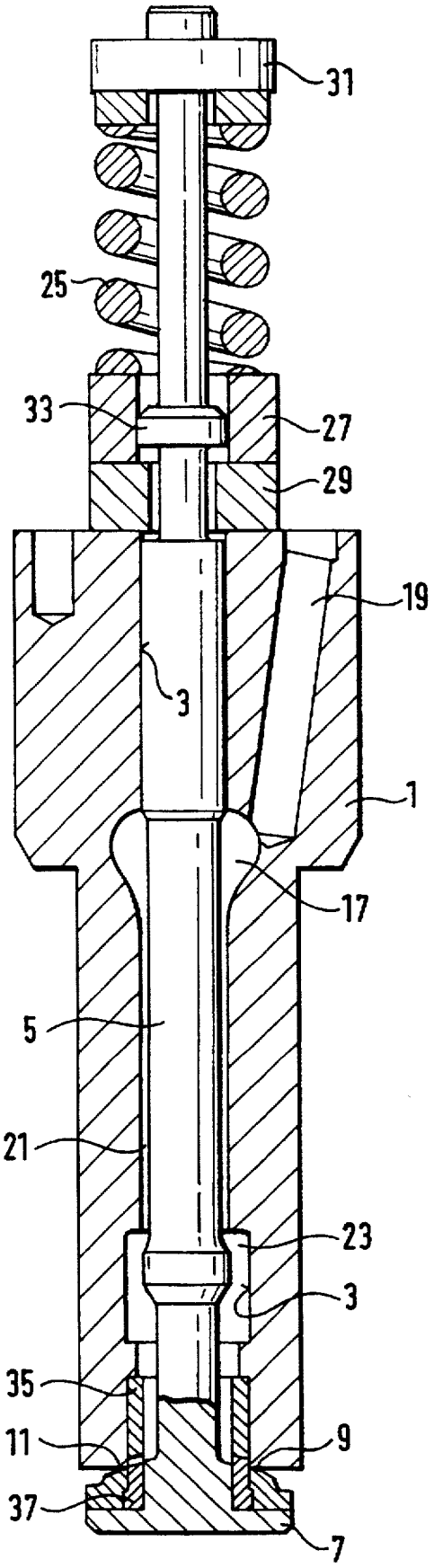
FIG. 1 shows a first exemplary embodiment of the injection valve in a longitudinal section, in which the high fuel pressure propagates to the injection apertures via a gap between the valve member and the annular insert.

The fuel injection valve depicted in FIG. 1 has a valve body 1 with a guide bore 3 in which a piston-shaped valve member 5 is guided in axially displaceable fashion, said valve member having at its combustion-space end, which projects from the guide bore 3, a valve head 7 acting as a closing head. Arranged on that end face of the valve head 7 which faces the valve body 1 is a sealing surface 9 which interacts with a valve seat surface 11 on the combustion-space end face of the valve body 1 and, in the process, forms a sealing cross section 51. As illustrated on an enlarged scale in FIG. 2, this sealing cross section 51 is preferably designed as a sealing edge which extends around the circumference, a first sealing edge 13 being provided on the valve seat surface 11 and a second sealing edge 15 interacting with the latter being provided on the sealing surface 9 of the valve member.

Provided on the guide bore 3 shown in FIG. 1 is an annular space which forms a collecting chamber 17 into which there opens a fuel injection line 19 fed by a high-pressure fuel feed pump and which is connected by way of an annular gap 21 between the stem of the valve member 5 and the wall of the guide bore 3 to a pressure space 23 which is bounded axially by the valve head 7 and from which, in turn, injection apertures lead off to the combustion space of the internal combustion engine to be supplied, the design of said openings being explained in greater detail below. In the rest position, the valve-sealing surface 9 of the valve member 5 of the injection valve or, more precisely, the sealing edge 15 on its valve head 7 is pulled against the valve seat surface 11 or, more precisely, the sealing edge 13 on the valve body 1 by a closing spring 25 which is supported via a distance sleeve 27 and a stop washer 29 on the end of the valve body 1 facing away from the combustion space and acts via a spring plate 31 on that end of the valve member 5 which is remote from the head 7.

The opening stroke movement is here initiated in a known manner by the alternating high-pressure supply of fuel from the feed pump to the injection valve via the injection line 19, the high fuel pressure acting on the valve head 7 of the valve member 5 raising the valve member 5 from its valve seat 11 counter to the force of the closing spring 25. To limit the total stroke of the valve member 5, its stem is, in the exemplary embodiment, offset at the level of the stop washer 29 to form a stop collar 33 which, in the closed position of the valve member 5, is at a distance corresponding to the total stroke from the stop washer 29, other stroke stops also being possible as an alternative to this stop.

For control of the size of the aperture cross section of the injection apertures of the injection valve in a manner which varies as a function of the engine speed or the load, two annular inserts (illustrated on an enlarged scale in FIG. 2) which can be displaced axially relative to one another are integrated into the injection valve, and of these annular inserts a first annular insert 35 is firmly connected to the valve body 1 in the region of the combustion-space end of the guide bore 3 and a second annular insert 37 is firmly connected to the axially displaceable valve member 5 in the region of the valve head 7. The annular inserts 35, 37 which, with their internal wall surfaces, delimit the pressure space 23 radially towards the outside and thus permit the supply of fuel to the injection apertures by means of a gap formed between the stem of the valve member and the annular inserts 35, 37, each have on their mutually facing end faces a comb-like crown toothing 39, these being designed in such a way that, complementary to one another, they engage in one another. The aperture cross sections 49 of the injection apertures are formed between the end faces 43 of the axially projecting studs 41 of the crown toothing 39 of the first annular insert 35 and the end faces 47 of the in each case complementary slot base 45 of the crown toothing 39 of the second annular insert 37, the aperture cross sections being variable from the closed state to a maximum value by means of the stroke of the valve member 5. In this arrangement, the crown toothing 39 of the first annular insert 35 is arranged in such a way that the end face 43 of the fixed studs 41, in particular the radially outer end of said end face, ends at the sealing edge 13 on the valve body 1. The end face 47 of the slot base 45 of the crown toothing 39 of the second annular insert 37 should end in a corresponding manner at the sealing edge 15 on the valve head 9, thus ensuring that the opening of the aperture cross section 49 does not occur before the opening of the sealing cross section 51—situated downstream—between the sealing edges 13, 15 arranged radially to the outside of the annular inserts 35, 37, which would result in uncontrolled injection over the entire annular sealing cross section 51.

The sealing of the aperture cross sections 49 is here accomplished by means of a narrow gap s between the respective axial slot flanks, for which purpose said gap should be made as small as possible, to which end the crown toothing is produced micromechanically.

To obtain different injection jet shapes, it is moreover possible to vary the shape of the end faces 43, 47 of the stud 41 and the slot base 45 although the interacting end faces 43, 47 should preferably be made parallel. In addition, the end faces 43, 47 can, as illustrated in the first exemplary embodiment, be chamfered in the direction of the opening stroke movement in order to obtain a more favorable injection jet shape.

Figure 4:
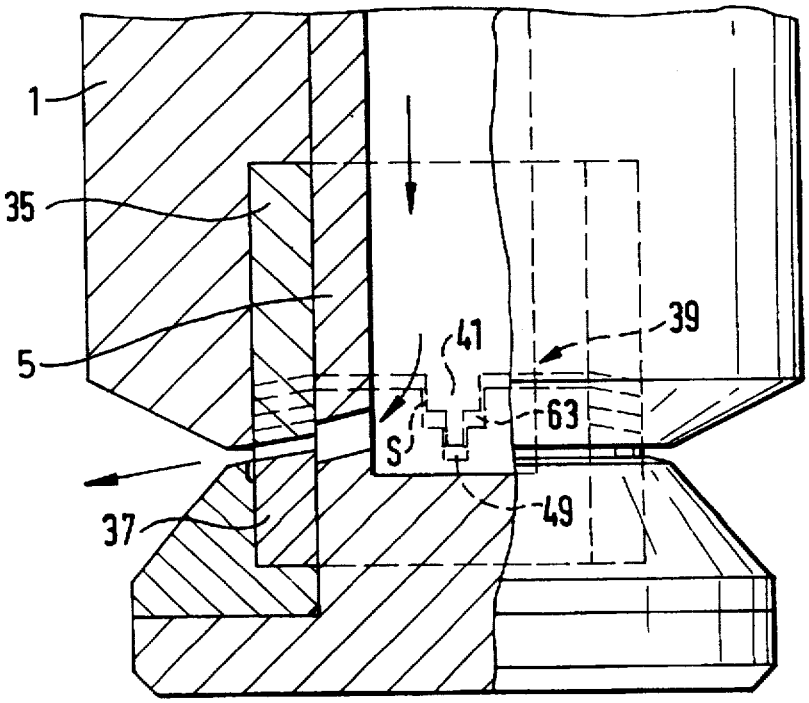
FIG. 4 shows an enlarged partial section of FIG. 3, in which an additional pressure space at the stud of the crown toothing is shown.
Figure 3:
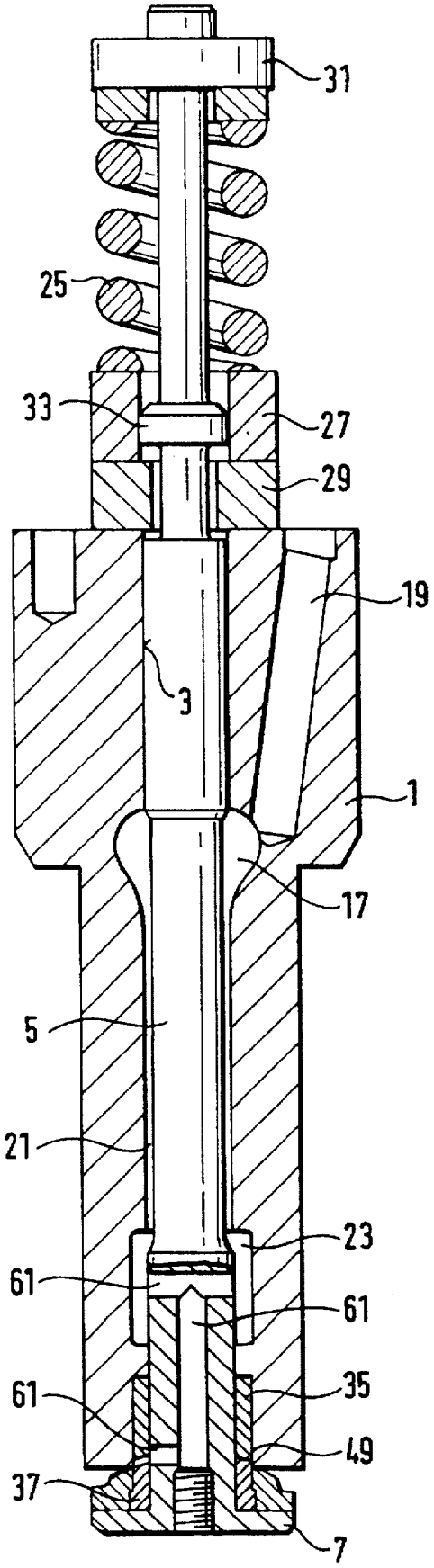
FIG. 3 shows a second exemplary embodiment similar to the illustration in FIG. 1, in which the fuel is supplied to the spray holes via bores in the valve member.
Figure 5:
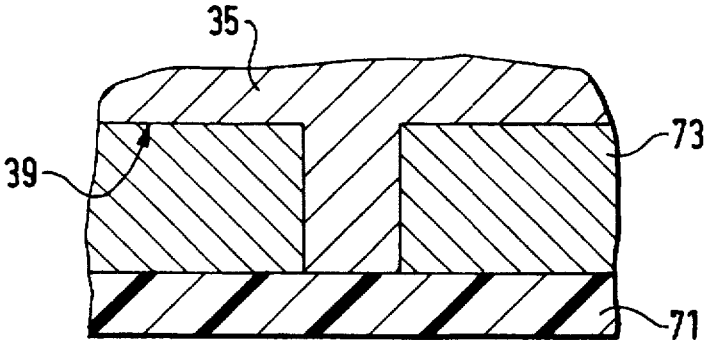
FIGS. 5 to 8 show sketches intended to explain the processing sequence for the application and removal of the sacrificial layer to/from the crown toothing of the annular inserts.
Figure 6:
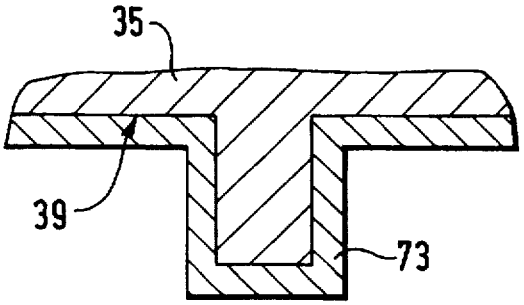
Figure 7:
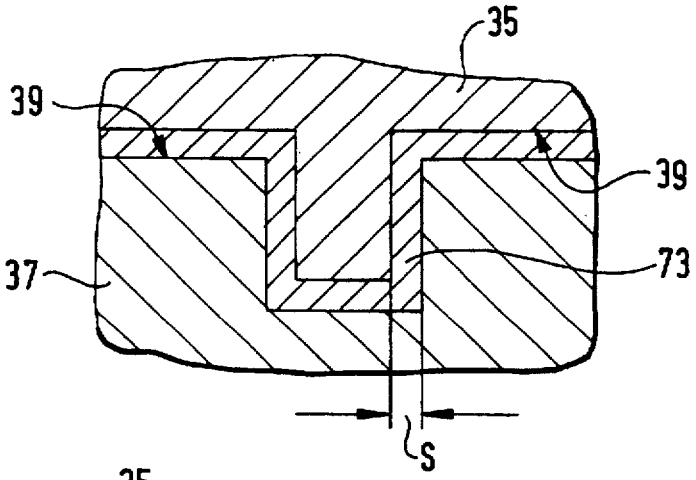

The second exemplary embodiment, illustrated in FIGS. 3 and 4, differs from the first exemplary embodiment merely in the manner in which the fuel is supplied to the aperture cross sections 49 of the injection apertures. Here, the valve member 5 has bores 61 which start from the pressure space 23 and the outlet openings which open at the annular inserts 35, 37 at the level of the aperture cross section 49.

As illustrated in FIG. 4, a further pressure space 63 is furthermore provided at the studs 41 of the crown toothing 39 of the first annular insert 35, this pressure space 63 being formed by a step-like cross-sectional enlargement of the stud 41 and a correspondingly shaped step in the slot when the aperture cross section 49 between the crown toothings 39 of the annular inserts 35, 37 is open. This pressure space 63 supports the stud end after it has emerged from the narrow guiding gap s at the slot flanks and prevents a shift in its position due to loads from one side.

In order to avoid shearing off of the studs 41 due to a torque on the moving parts, it is furthermore possible to provide an anti-rotation safeguard, e.g. a stud and slot connection, on the annular inserts 35, 37.

Figure 2:
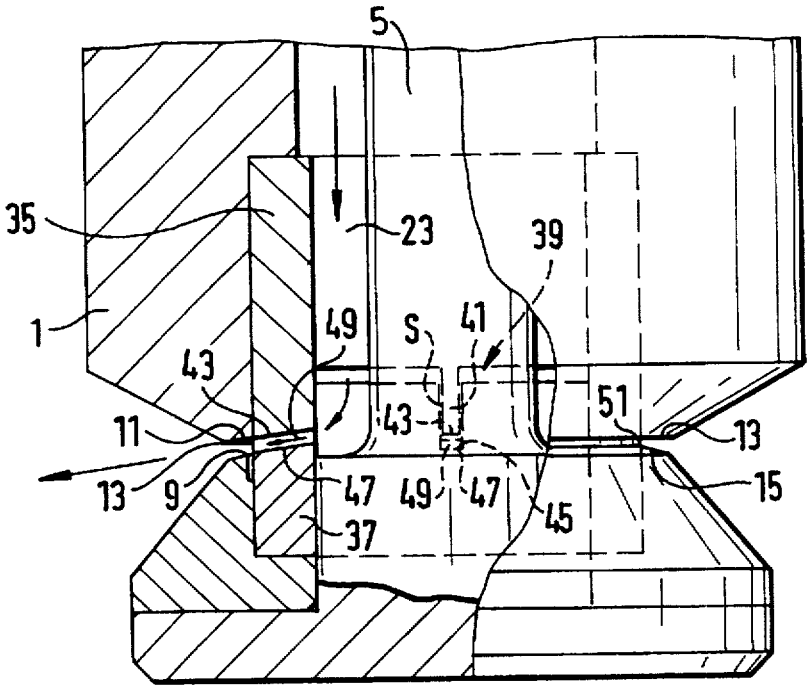
FIG. 2 shows an enlarged partial section of FIG. 1 to illustrate the crown toothing on the annular inserts.

The crown toothing 39 of the annular inserts 35 and 37 are shown in FIGS. 2 and 4 looking toward the inserts 35 and 37. FIGS. 2 and 4 are partial cross sections. Therefore, in viewing FIGS. 2 and 4, the crown toothing 39 is shown looking at the outside surface of the annular inserts 35 and 37 which are not shown in cross section. As seen in FIG. 2, there is an annular spacing between the annular inserts 35 and 37 shown at the end of the arrow 39 and an axial spacing between the end of the stud 41 and the opening at 49. The fuel will then pass through the axial spacing at 49 and out between the surfaces 13 and 15 as the valve head opens and the fixed annular insert in the valve body 1 remains in place as the annular insert 37 fixed to the valve head moves with the valve head to form the spacing at 49.

As seen in FIG. 4, there is a spacing between the annular insert at the end of the stud at 49 and at the shoulder at 63. Therefore, fuel can pass through the spacing at 49 and at 63 and on out between the surfaces 13 and 15 as the valve head opens. As the valve head opens, the annular insert 35 remains fixed in the valve body 1 and the annular insert 37 remains fixed in the valve head 7. Therefore, as the valve head opens to form a spacing between the seats 13 and 15, fuel passes through the spacings at 49 and 63 and out between the seats 13 and 15.

FIGS. 5 to 8 show a method for manufacturing the high-precision crown toothing 39 on the annular inserts 35, 37, which are preferably made of a different material from the components which form the sealing cross section 51.

The initial shape of the crown toothing 39 is there first of all produced by a fine mechanical or, preferably, micromechanical method. In a next work step, shown in FIGS. 5 and 6, a sacrificial layer 73 is applied by electrochemical deposition to the surface of the crown toothing 39 by placing it on a base plate 71, the thickness of this layer determining the gap s between the slot flanks of the studs 41 and the slot bases 45. In a following work step, shown in FIG. 7, the crown toothing 39 of the second annular insert 37 is connected by electrochemical deposition to the crown toothing 39 of the first annular insert 35, forming a solid composite ring, any desired compensation of tolerances between the studs 41 and slots 45 distributed over the entire end face of the annular inserts 35, 37 being possible by means of the sacrificial layer 73, this compensation simplifying the installation of the annular inserts 35, 37 despite the narrowness of the gap s. This composite assembly of annular inserts is then mounted as an integral component on the valve member 5 and into the guide bore 3, the rigid connection of the annular inserts 35, 37 preventing damage to the precise guiding play of the axial slot flanks of the crown toothings 39.

Figure 8:
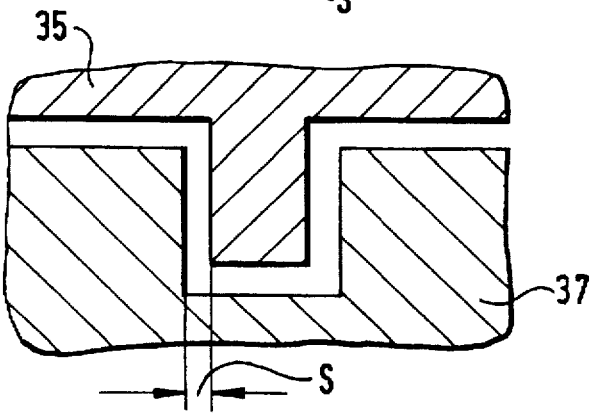

In the installed state, the sacrificial layer is removed, by means of an etching bath for example, leaving the gap s as shown in FIG. 8, which permits good axial guidance of the annular inserts 35, 37 relative to one another while at the same time providing a high sealing effect.

The injection process on the fuel injection valve according to the invention takes place, during the known opening stroke movement of the valve member 5 counter to the force of the closing spring 25, by the opening of the sealing cross section 51 and simultaneously or slightly later the opening of the aperture cross sections 49 distributed uniformly around the circumference of the annular inserts 35, 37, these aperture cross sections being formed between the end faces of the annular inserts as already described by the axial displacement of the second annular insert 37, firmly connected to the valve member 5, relative to the fixed first annular insert 35. A slight delay of the opening of the aperture cross section 49 relative to the opening of the sealing cross section 51 can here be achieved by an axial offset of the end faces 43 of the studs 41 of the crown toothing 39 of the first annular insert 35 in the direction of the closing stroke movement. However, the axial offset must be large enough to ensure that the aperture cross sections 49 remain closed by the wall of the valve body 1 until the sealing cross section 51 has been opened, in order to avoid uncontrolled injection over the entire sealing cross section 51.

The aperture cross sections 49 grow larger as the stroke of the valve member increases, to a maximum value (about 0.2 to 0.4 mm), the size of the aperture cross sections 49 being variable as a function of the high fuel pressure and the duration of its supply, making it possible in an optimum manner to achieve the small aperture cross sections 49 of the injection apertures in the case of low load states of the internal combustion engine to be supplied and large aperture cross sections 49 of the injection apertures in the case of high load states.

The continuous change in volume of the aperture cross sections 49 of the injection apertures ensures that the direction in which the injected fuel is sprayed is constant, even with the aperture cross section only partially open.

By means of the fuel injection valve according to the invention, it is thus possible in a structurally simple manner to achieve a separation between the aperture cross section of the injection apertures and the sealing cross section on the injection valve while retaining the advantages of a variable aperture cross section of the injection apertures.

The foregoing relates to preferred exemplary embodiments of the invention, it being understood that other variants and embodiments thereof are possible within the spirit and scope of the invention, the latter being defined by the appended claims.

We claim:

1. A fuel injection valve for internal combustion engines of the type which open outwards, comprising a valve member (5) having a valve stem, said valve member is displaced in a bore (3) in a valve body (1) by fuel under pressure, counter to an action of a closing spring (25), and at a combustion-space end of the valve body has a valve head (7) which is provided with an encircling sealing edge (15) or annular sealing surface (9) which faces and interacts with an encircling valve seat (11) provided on the combustion-space end of the valve body (1), said valve head directly adjoins radially towards an inside an axially extending part with a crown toothing (39) which, by means of its crown toothing (39), meshes in a corresponding complementary crown toothing situated on an end of a part of the valve member adjoining the valve seat (11) radially towards the inside, said injection valve includes a device including complementary annular parts which form an aperture cross section (49) of injection apertures to form fuel injection jets and by means of which the aperture cross section (49) is varied as a function of an outward stroke of the valve member, wherein the fuel injection valve is divided into a valve part forming the encircling valve seat (11) and into a valve-closing member which interacts with said valve encircling valve seat and into said complementary annular parts which form the aperture cross section (49) of the injection apertures, the valve part with the encircling valve seat (11) being arranged downstream, as seen in the injection direction, of said complementary annular parts forming the aperture cross section (49) and opening and closing the fuel injection valve independently of the encircling valve seat.

2. The fuel injection valve as claimed in claim 1, wherein those parts of the injection valve which have the valve seat (11) and the valve-sealing surface (9) and those parts which form the aperture cross section (49) and bear the crown toothings (39) are manufactured from different materials.

3. The fuel injection valve as claimed in claim 1, wherein the aperture cross sections (49) of the injection apertures are formed between mutually complementary sets of crown toothings (39), the crown toothings (39) each being arranged on end faces of two complementary annular inserts with one insert fixed to said valve body and a second insert fixed to said valve head (7) which are displaced axially relative to one another and to an interior wall surface of which the high fuel pressure is applied.

4. The fuel injection valve as claimed in claim 3, wherein the part adjoining the valve seat (11) is designed as a first annular insert (35), which is connected to the valve body (1) in such a way as to be leaktight under high pressure, and wherein the part situated on the valve head (7) is designed as a second annular insert (37), which is connected to the axially displaceable valve member (5), likewise in such a way as to be leaktight under high pressure, the variable aperture cross sections (49) being formed between the end faces (43, 47) of the axially projecting studs (41) of the crown toothing (39) of the first annular insert (35) and the respective complementary slot base (45) of the crown toothing (39) of the second annular insert (37).

5. The fuel injection valve as claimed in claim 4, wherein the end faces (47) of the slot base (45) of the second annular insert (37) are in alignment with or set back in relation to the sealing edge (15) or the sealing surface (9) of the valve head (7), and the end face (43) of the studs (41) of the first annular insert (35) is in alignment with or set back in relation to the valve-seat surface (11).

6. The fuel injection valve as claimed in claim 4, wherein the axially aligned slot flanks of the inter-engaging crown toothings (39) rest on one another and seal the aperture cross section (49).

7. The fuel injection valve as claimed in claim 6, wherein a gap (s) remaining between the slot flanks of the crown toothing (39) approaches zero.

8. The fuel injection valve as claimed in claim 4, wherein the end faces (43) of the studs (41) of the crown toothing (39) of the first annular insert (35) and the slot base surfaces (47) of the crown toothing (39) of the second annular insert (37) which interact therewith are configured in such a way as to run parallel to one another.

9. The fuel injection valve as claimed in claim 8, wherein the stud and slot base surfaces (43, 47) bounding the aperture cross section (49) are chamfered in such a way that the aperture cross section (49) slopes radially outwards in the direction of the opening stroke movement of the valve member (5).

10. The fuel injection valve as claimed in claim 4, wherein, above the valve seat (11), the studs (41) of the first annular insert (35) have a step which, with a complementary step in the slot in the second annular insert (37), delimits a pressure space (63) which stabilizes the axial end of the stud (41) when the aperture cross section (49) is open.

11. The fuel injection valve as claimed in claim 4, wherein the annular inserts (35, 37) are secured against independent rotation by means of an anti-rotation safeguard.

12. The fuel injection valve as claimed in claim 3, wherein the crown toothing (39) is produced micro-mechanically and before being installed in the fuel injection valve, the annular insert (35, 37) are connected firmly to one another by means of a sacrificial layer (73) applied electrolytically to the crown toothing (39), this connection being canceled again after installation.

* * * * *